United States Patent [19]

Noffke et al.

[11] 4,438,673

[45] Mar. 27, 1984

[54] SLITTER MOUNTING BRACKET

[75] Inventors: Roy O. Noffke; Thomas G. Engel, both of Appleton, Wis.

[73] Assignee: Appleton Papers, Inc., Appleton, Wis.

[21] Appl. No.: 302,131

[22] Filed: Sep. 14, 1981

[51] Int. Cl.[3] ..... B26D 1/24

[52] U.S. Cl. ..... 83/502; 83/482; 83/497; 83/505

[58] Field of Search ..... 83/500, 501, 502, 503, 83/504, 481, 482, 505, 506

[56] References Cited

U.S. PATENT DOCUMENTS

| | | | |
|---|---|---|---|
| 3,041,907 | 7/1962 | Gallagher | 83/502 X |
| 3,185,010 | 5/1965 | Printz et al. | 83/504 X |
| 3,186,282 | 6/1965 | Waterhouse | 83/500 X |
| 3,651,728 | 3/1972 | Young | 83/503 X |
| 3,877,335 | 4/1975 | Lange | 83/504 X |

*Primary Examiner*—Donald R. Schran

*Attorney, Agent, or Firm*—Birch, Stewart, Kolasch & Birch

[57] ABSTRACT

A slitter apparatus for cutting a continuous web is disclosed comprising a slitter blade and a slitter mounting bracket. The bracket comprises a threaded depth-post assembly, a spring unit for maintaining the desired tension at the cutting surface, and a dove-tail spring-loaded base.

7 Claims, 5 Drawing Figures

SLITTER MOUNTING BRACKET

BACKGROUND OF THE INVENTION

This invention relates to a slitter apparatus and more specifically to a slitter mounting bracket for an endless web material.

In processing paper it is a usual operation to transform wide-width rolls of paper, as manufactured, into rolls of narrower widths. This is accomplished by a machine referred to in the industry as a slitter which, in the usual installation, longitudinally advances a paper web between opposed sets of rotary knives or a cutting blade and an opposing anvil. The slitting apparatus is generally referred to as the narrow-cut or shear type which is used to trim and cut web material on the web winding machines. This type of slitting apparatus is generally in the form of a thin steel disk manufactured from hardened and tempered tool steel, and peripherally ground to obtain a sharp edge in order to form a circular knife. The disk cooperates with an opposing driven cutter disk or drum and is kept in rotating contact by overlapping and engaging the side of the drum, and the plane of the axis of rotation thereof will normally be at a slight angle with respect to the axis of rotation of the cooperating drum to form a shear angle. The blade and drum, while rotating together, must be maintained in contact at an optimum amount of pressure in order to sever a web of material with a consistently clean cut. The necessity for maintaining the optimum shear angle and optimum pressure is well recognized by the prior art and various means have been devised in order to achieve these results, the most common of which being the utilization of spring pressure in order to maintain the required parameters. In addition, depth adjustment of the cutting edge must be maintained cooperating with the spring devices so as to maintain the necessary depth setting, permitting displacement-movement of the cutting edge while maintaining a set tension. In addition, the base mount for the slitter must be such that the proper blade mounting angles are maintained with respect to the corresponding drum or anvil face.

Although the heretonow utilized slitter mechanisms have been found useful in the paper web industry, there are known disadvantages in the use of the present known systems producing nonuniform and inefficient slitting operations. Generally, the currently used mechanisms employ no effective means for controlling the spring tension applied and thus, variable tensions are produced, run to run, resulting in nonuniform, extensive blade and anvil wear producing a rough, dust-prone cut. The accumulation of surface dust generated during the slitter operation is magnified when the resulting paper is used in a printing operation which leads to poor print quality as a result of a phenomenon known as ink-piling. Further, the current depth adjustments are often cumbersome and imprecise and thus contribute to improper blade positioning with respect to the opposing anvil, with the point of cut changing with a change in blade diameter. Tests have determined that optimum slitting can only be achieved by proper blade positioning with respect to the anvil. The change in location of cut, with a change of blade diameter, normally results in additional interference of the blade with the cut paper edge. The screw device used for controlling depth of the cutting edge in one prior art embodiment continually exerts pressure on the surface of the mounting bracket base, resulting in wear to the base surface. In addition, due to the type of movement and pressure exerted on the threads within the bracket housing, stripping almost inevitably occurs. The spring which is positioned between the bracket housing and base undergoes relatively high tension and force due to the weight of the bracket and vibrations encountered during operation. At high machine speeds, when vibration becomes a major concern, movement, particularly that regulated by the depth-spring, becomes quite noticeable thus resulting in imprecise slitting. In many brackets the base mount configurations do not ensure squaring at the blade-anvil interface. Thus, it is possible for the blade to be mounted in a somewhat cocked position resulting in excessive anvil-blade wear producing an ineffective cut.

SUMMARY OF THE INVENTION

Therefore, it is an object of the present invention to provide a slitting mechanism which will overcome the above-noted and other disadvantages.

It is a further object of the present invention to provide a mechanism for providing precise and effective depth control in a web slitting system.

It is another object of the present invention to provide a means for ensuring constant, yet versatile, applied tension control.

Still, a further object of the present invention is to provide coil springs and/or rubber grommets which ensure a constant and uniform applied tension to a blade spring thereby enabling precise, relatively dust free slitting of paper under adverse operating conditions.

Yet, still another object of the present invention is to provide a spring-loaded, dove-tail base mount which guarantees absolute blade-anvil squaring while maintaining the proper blade mounting angles, curtailing blade-anvil wear and thus promoting an effective cut.

The foregoing objects and others are accomplished in accordance with the present invention generally speaking by providing a slitter apparatus comprising a slitter blade, in the form of a thin metal disk peripherally ground to obtain a sharp edge and a slitter mounting bracket comprising a threaded depth-post assembly incorporated in the housing of the bracket mounting, a spring configuration or unit for ensuring constant tension control, more fully discussed below, and a modified, dove-tail base mount, spring-loaded for establishing absolute blade squaring at the surface between the blade and back-up anvil while maintaining the proper slitter blade mounting angles. The threaded depth post assembly provides an accurate depth setting while maintaining a set tension. The spring tension unit is made up of a blade or mounting stock spring, a spring mounting band and a means for regulating the tension at the cutting surface. The tension applied at the slitter-anvil interface is governed by the displacement of the tension regulating means at the spring mounting band, the displacement observed being a measure of the amount of force or tension applied between the slitter blade and the anvil at the referenced blade-anvil interface. The tension regulating means, for example, can be one or more coil springs and/or grommets positioned on one or both sides of the blade spring stock. Through a hinge attached between the blade spring stock and the bracket housing, horizontal displacement is possible while still maintaining the necessary depth control through the depth-post assembly. The initial operating displacement setting is established by a swinging stop located between the blade spring stock and the spring mounting band. The operator sets the slitter blade against the anvil and applies pressure until the stop swings free, at which time the operator tightens down the dove-tail base. The resulting setting establishes the optimum pressure between the blade and the anvil. The swinging stop provides the operator with a further indication of the applied tension. Both the vertical and horizontal mounting angles are established at the blade-anvil interface for the purpose of maintaining a precise point of contact. The base mount or support is a modified dove-tail base with a spring-loaded clamp shoe for ensuring optimum blade squaring at the anvil.

It has been determined in the course of the present invention that a highly efficient and regulated slitting mechanism can be provided wherein a spring tension unit provides for controlled movement of the slitter assembly so as to regulate the tension at the slitter blade-anvil interface, minimizing the movement therebetween, resulting in extended blade life as well as diminished anvil wear, and providing efficient slitting of the particular web of paper. A depth-post assembly is provided which enables accurate depth setting while maintaining the desired tension. A spring-loaded dove-tail base mount provides for absolute blade-to-anvil squaring while maintaining the proper blade mounting angles, curtailing blade and anvil wear and promoting efficient cutting.

GENERAL DESCRIPTION OF DRAWINGS

The invention is further described by way of the accompanying drawings wherein:

FIG. 1 represents a side view of the slitter apparatus of the present invention;

FIG. 2 provides a rear view of the slitter apparatus;

DETAILED DESCRIPTION

Figure 1:
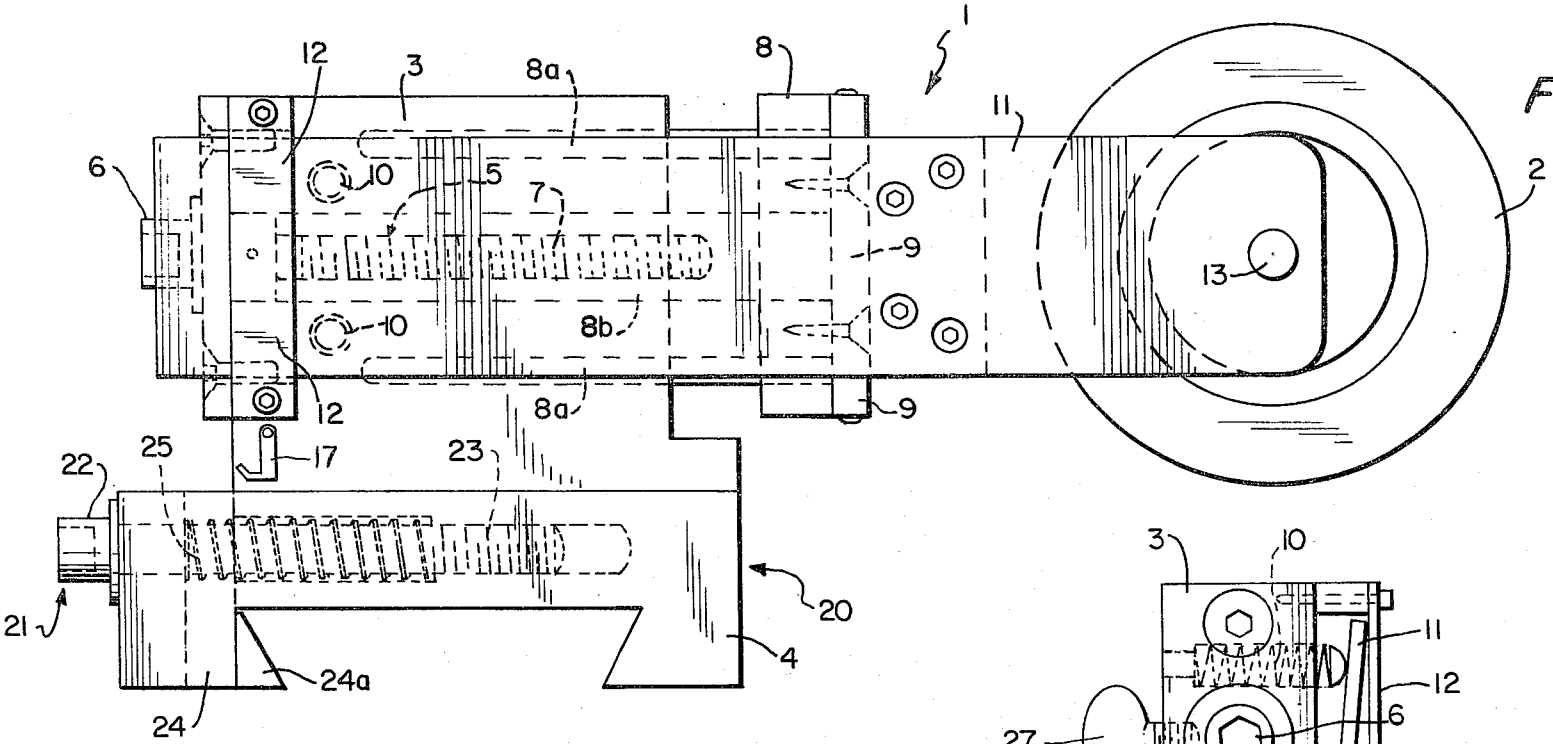

Referring now to FIG. 1 there is seen a slitter apparatus of the present invention generally designated 1 comprising a blade 2, a threaded depth-post housing 3 and a mounting base 4. A threaded depth-post assembly comprising a depth adjusting screw 5 with a head portion 6, a threaded portion 7, and a ram portion 8 cooperates via hinge 9 with a spring tension unit. The spring tension unit is herein represented as being made up of two coil springs 10, a blade or mounting spring 11 and a spring mounting band 12. The threaded depth post assembly is mounted through its ram section 8 to the blade spring stock 11 by way of the spring-depth stock hinge 9. The ram section 8 is extended or retracted by way of extensions **8*a* and the female receptacle 8*b* for the threaded portion 7 of screw 5. The slitter blade 2 is attached to the end of the blade spring 11 opposite the spring mounting band 12 by bolt 13. The housing 3 is affixed or welded to a spring-loaded base mount 4 which comprises a screw tightening device 21 consisting of an adjusting screw head 22 and a threaded portion 23. The support base mount 4 further includes a dove-tail locking clamp or shoe 24 spring loaded by member 25, the step portion 24*a* of the locking shoe being retained by the spring while mounting the bracket. The swinging stop 17** is shown in its down position.

Figure 2:
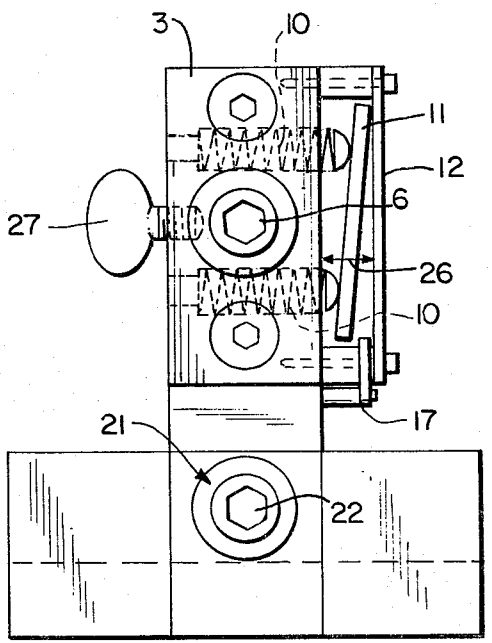

Referring now to FIG. 2 there is seen a rear view of the slitter apparatus of the present invention. The spring-loaded set screw 21 regulates and adjusts the base of the slitter mounting bracket. The coil springs 10 together with the spring mounting band 12 confine and regulate the placement of the blade or mounting stock spring 11 so as to maintain the proper mounting angles. The swinging stop 17, shown in its up position, indicates the initial proper coil spring displacement 26. A locking thumb screw 27 is provided for locking the depth-post in a fixed position.

Figure 3:
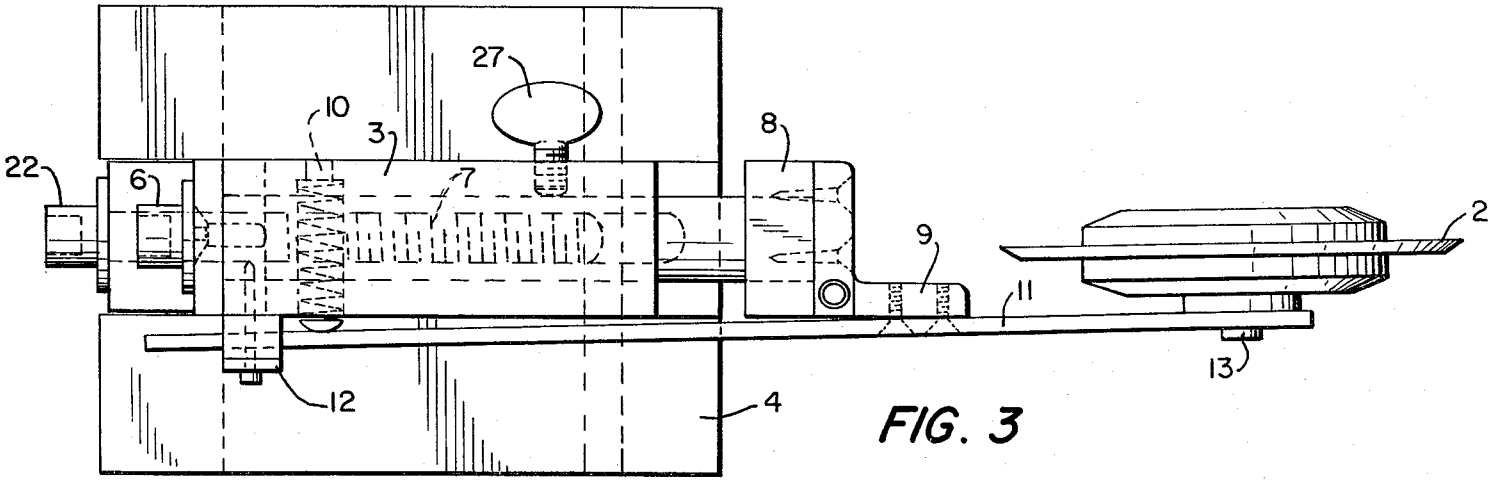
FIG. 3 represents a top view of the slitter apparatus.

Referring now to FIG. 3 there is seen a top view of the slitter apparatus of the present invention illustrating the spring tension unit comprising the coil springs 10, the blade or mounting stock spring 11 and the spring mounting band 12. The spring depth stock hinge 9 fastens the blade spring 11 to the threaded depth post ram section 8. Other related sections as described in the previous figures are identified using the identical numbers.

Figure 4:
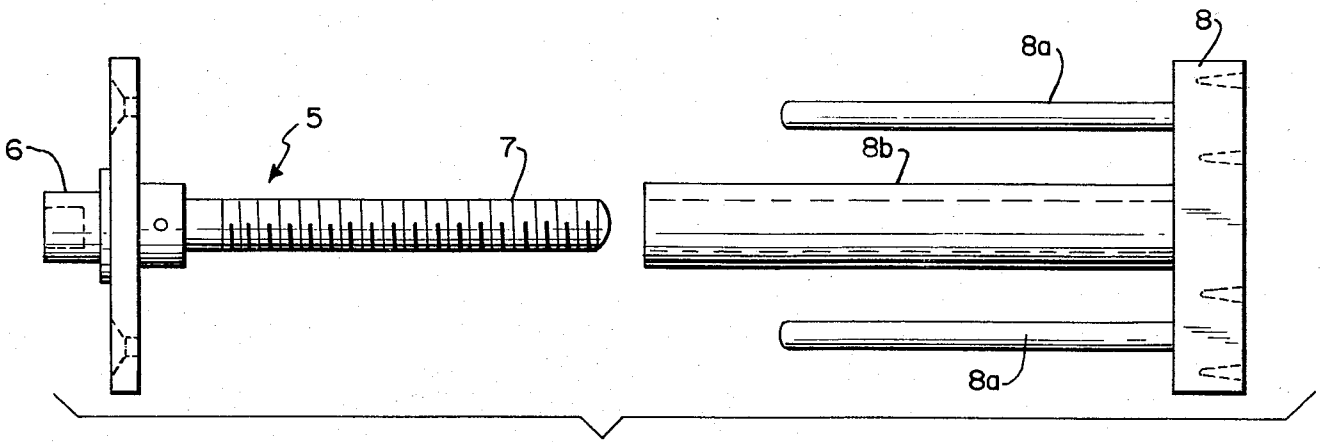
FIG. 4 represents a side, disassembled view of the depth-post assembly configuration.

FIG. 4 represents the depth-post assembly of the present invention comprising the depth-adjusting screw 5 comprising head portion 6 and threaded section 7. The ram portion 8 is guided by extensions **8*a* while being driven by the depth-adjusting screw 5 in response to the action of the threaded section 7 with the receptacle portion 8*b*. With heretofore slitter mechanisms using coil springs for controlling the tension with respect to the slitter blade and the opposing surface, whether it be an anvil surface or a second slitter blade, the coil springs were generally located on the slitter blade per se. The blade movement with this type of spring tension control is relatively unlimited. With the blade assembly of the present invention, the bracket employs means such as coil springs or grommets which experience very limited movement resulting in a much more extensive spring and blade life. In addition, movement is roughly limited to only one direction, such as that indicated by the coil spring displacement at the mounting band in FIG. 2**. The movement observed, including that at relatively high machine speeds, is quite minimal. The slitter bracket housing is mounted, as indicated above, by a base mount assembly which utilizes a modified spring-loaded dove-tail base whereby mounting is accomplished by advancing a spring-loaded step toward the mounting bed. The instant bracket with its corresponding support mount is precisely constructed so as to ensure a square mount between the slitter cutting blade and the opposing anvil surface.

Figure 5:
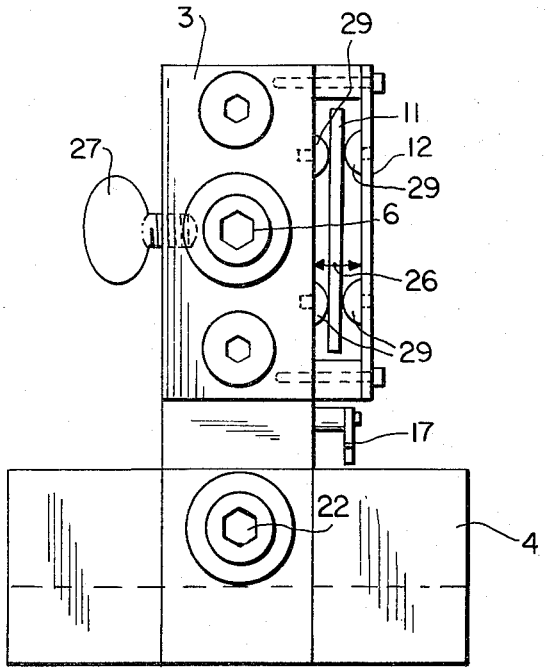
FIG. 5 represents a second rear view of the slitter apparatus reflecting an alternate embodiment.

FIG. 5 is exemplary of the substitution of rubber grommets 29 for the coil springs 10 of FIG. 2. In this illustration, the tension regulating grommets are positioned on both sides of the blade stock 11, as can be the coil springs. Further, if desirable, the coil springs and grommets can be used jointly in the same configuration. Swinging stop 17 is again represented in its down position.

Heretofore, pressure exerted by the blade against the anvil has been randomly established by the operator. There has been no reliable method available for arriving at a uniform setting to obtain optimum operating conditions, particularly with respect to tension requirements. The setting has either been too light or, more often, the setting too heavy whereby the tension between the blade and anvil was unacceptable. Light tension yields non-uniform, imprecise jagged slitting while heavy tension causes excessive blade wear and may result in the blade jumping on top of the anvil. Variable tension settings also inhibit the implementation of the proper blade mounting angles. A drastic change in the tension employed may change the angles while utilizing excessive tension may eliminate them entirely. The bracket of the present invention provides the operator with an effective method of controlling the applied tension. Through effective tension control a more precise cut is achieved while markedly extending blade and anvil life.

As stated above, the spring tension is governed by the displacement of the tension regulating means at the spring mounting band, the coil spring(s) and/or grommets being associated with the bracket housing rather than the blade, as in the prior art configurations. The tension capacity can be effectively varied in the case of the coil springs by changing the coil spring gauge. The heavier the spring gauge, the more potential applied tension available. In the case of the grommets, the tension capacity is regulated according to the hardness of the rubber.

The slitter mounting apparatus of the present invention provides a threaded depth-post assembly which enables precise, effective depth control, a coil spring tension configuration which ensures constant, yet versatile tension control and a modified spring-loaded dovetail base which establishes absolute blade squaring at the anvil face, thereby maintaining the proper blade mounting angles. Angular adjustment in the horizontal direction can be achieved by substituting various spring-mounting steps or spacers between the coil spring mounting band 12 and the depth-post housing 3. By changing the steps at the spring mounting band, the potential horizontal mounting angle range is changed. The wider the step, the greater the displacement capacity of the spring mounting stock at the spring mounting band, and the greater the potential horizontal blade angle variability. With the bracket of the present invention the stability and precise of the depth post assembly prohibits undue movement and, even under adverse conditions, maintains the required depth. The bracket also features a depth-locking element adding to the reliability of the unit.

Although the spring tension unit of the present invention is described with respect to the utilization of coil springs and/or grommets, any suitable means may be substituted therefore to provide the desired effect such as the use of spring-loaded pins. As stated above when the tension regulating means takes the form of one or more coil springs and/or grommets, it has been determined that implementing the respective means on both sides of the blade spring stock produces effective cutting results at web speeds at least as high as 3000 feet per minute. Furthermore, where utilized, turn-style adjustments can be substituted for the set screw adjustments when desirable. A snap-on dove-tail base may be utilized in place of the set screw adjusted dove-tail base so as to lend flexibility to the configuration. With respect to the materials employed in the construction of the slitter mounting apparatus herein described, aluminum or any other suitable alloy may be substituted for the steel construction discussed above.

The invention being thus described it will be obvious that the same may be varied in many ways. Such variations are not to be regarded as a departure from the spirit of the invention and modifications as would be obvious to one skilled in the art are intended to be included within the scope of the following claims.

We claim:

1. An apparatus for slitting a continuous web of material which comprises in combination a slitter blade and a slitter mounting bracket, said bracket comprising a bracket housing having a threaded depth-post assembly for enabling precise, effect depth control of said slitter blade, a base mount for supporting said bracket housing and a means for maintaining the proper tension between said slitter blade and a cutting surface, said means comprising a spring tension unit including a blade spring having a forward end and a rear end, a spring mounting band, and a tension regulating means, said slitter blade being mounted to said blade spring at said forward end thereof, said spring mounting band being attached to said bracket housing at a rear portion thereof with said rear end of said blade spring being positioned between said housing and said spring mounting band, with said tension regulating means interacting with said blade spring at the site of location of said spring mounting band where said band is affixed to said housing to regulate said blade tension.

2. The apparatus as disclosed in claim 1, wherein said base mount comprises a spring-loaded clamp shoe for maintaining blade squaring at said cutting surface.

3. The apparatus of claim 1, wherein said bracket housing has front face portion and threaded depth-post assembly comprises a threaded member and a ram section which provides for the necessary depth control of said slitter blade, said threaded member projecting frmo said front face portion of said bracket housing and being integral with said ram section, said blade spring being hinged via said ram section to said mounting bracket housing, said hinge attachment providing for horizontal displacement capability of said slitter blade while maintaining the necessary depth control through said depth-post assembly.

4. The apparatus of claim 1, wherein said tension regulating means comprises at least one coiled spring and/or compressible grommet positioned between said bracket housing and said spring mounting band interacting with said blade spring thereby maintaining a constant tension on said blade spring translated to said slitter blade at the cutting surface, maintaining proper mounting angles.

5. The apparatus of claim 4 further including a swinging stop positioned between said blade spring and said spring mounting band for establishing the initial operating displacement of said blade spring.

6. The apparatus of claim 4 wherein said coil spring(s) and/or grommet(s) are positioned on both sides of said blade spring.

7. The apparatus of claim 1, further including a depth-locking element mounted on said bracket housing for locking said threaded member of said depth-post assembly.

* * * * *